United States Patent [19]

Schwartz

[11] Patent Number: 4,607,464

[45] Date of Patent: Aug. 26, 1986

[54] COATED ABRASIVE BACK UP PAD

[75] Inventor: Thomas W. Schwartz, Troy Township, St. Croix County, Wis.

[73] Assignee: Minnesota Mining and Manufacturing Company, St. Paul, Minn.

[21] Appl. No.: 670,292

[22] Filed: Nov. 13, 1984

[51] Int. Cl.[4] ..... B24D 9/08

[52] U.S. Cl. ..... 51/362; 51/376

[58] Field of Search ..... 51/358, 362, 376, 377, 51/378, 391, 389

[56] References Cited

U.S. PATENT DOCUMENTS

| | | | |
|---|---|---|---|
| 3,082,582 | 3/1963 | Jeske | 51/358 |
| 3,226,888 | 1/1966 | Erenyl | 51/362 |
| 3,707,059 | 12/1972 | Burtch et al. | 51/358 |
| 3,879,904 | 4/1975 | Hafner | 51/362 X |
| 4,222,204 | 9/1980 | Benner | 51/362 |

*Primary Examiner*—Robert P. Olszewski

*Attorney, Agent, or Firm*—Donald M. Sell; James A. Smith; William L. Huebsch

[57] ABSTRACT

A coated abrasive back up pad comprising a layer of resiliently compressible foam, a generally rigid backing plate fixed to one surface of the layer of foam and including, structure adapted for coupling the back up pad to a drive motor, and a flexible magnetized layer fixed to a surface of the foam layer opposite the backing plate and having a generally planar outer support surface. The foam layer includes a lip extending around the peripheral edge of the magnetized layer to protect that edge during use of the pad to drive a sheet of coated abrasive.

10 Claims, 4 Drawing Figures

COATED ABRASIVE BACK UP PAD

TECHNICAL FIELD

The present invention relates to back up pads of the type adapted to hold a sheet of coated abrasive material and to be driven by a drive motor to abrade a surface with the coated abrasive material.

BACKGROUND ART

U.S. patent application No. 528,043, filed Aug. 31, 1983, teaches the use of a flexible magnetized layer (e.g., the material commercially designed "Plastiform" available from Minnesota Mining and Manufacturing Company, Saint Paul, Minn.) to magnetically hold and drive flexible sheets of coated abrasive material containing ferromagnetic material. Typically the magnetized layer is incorporated in a back up pad wherein it is attached to one surface of a layer of resiliently compressible foam, the back up pad either being adapted to be manually manipulated or having a rigid backing plate adapted to be driven by a drive motor attached to an opposite surface of the layer of foam so that the motor can be used to drive the pad and thereby the abrasive against a surface to be abraded, while the layer of foam affords applying resilient pressure between the abrasive and the surface to be abraded.

The flexible magnetized layer can securely hold the abrasive sheets in place to abrade a workpiece while the back up pad is being used manually or driven by the motor, however, the material of the magnetized layer is somewhat friable and thus the edge of the magnetized layer can be worn away during use.

DISCLOSURE OF THE INVENTION

The present invention provides a coated abrasive back up pad including a flexible magneized layer that effectively protects the edge of the magnetized layer against abrasion.

The coated abrasive back up pad according to the present invention, like prior art pads, comprises a layer of resiliently compressible foam. A flexible magnetized layer comprising magnetized particles within a polymeric matrix is fixed to one surface of the layer of foam, which magnetized layer has a generally planar support surface opposite the layer of foam and has a peripheral edge surface adjoining the support surface that is disposed generally normal to the support surface. The back up pad according to the present invention is improved in that the foam layer includes a protective lip extending around the peripheral edge of the magnetized layer which lip has a peripheral surface generally coplanar with the support surface to help support an abrasive sheet.

Preferably the foam is of polyether or polyester urethane and the lip is in the range of about ¼ to 1 centimeter wide in a direction parallel to the peripheral surface. Such a lip has been found equally useful to protect the edges of flexible magnetized layers on rectangular back up pads of the type called file shoes which are used on air files, and on circular back up pads of the type called disc pads which are used on rotary grinders.

BRIEF DESCRIPTION OF THE DRAWING

The present invention will further be described with reference to the accompanying drawing wherein like reference numerals refer to like parts throughout the several views and wherein.

DETAILED DESCRIPTION OF THE PREFERRED EMBODIMENTS

Figure 2:
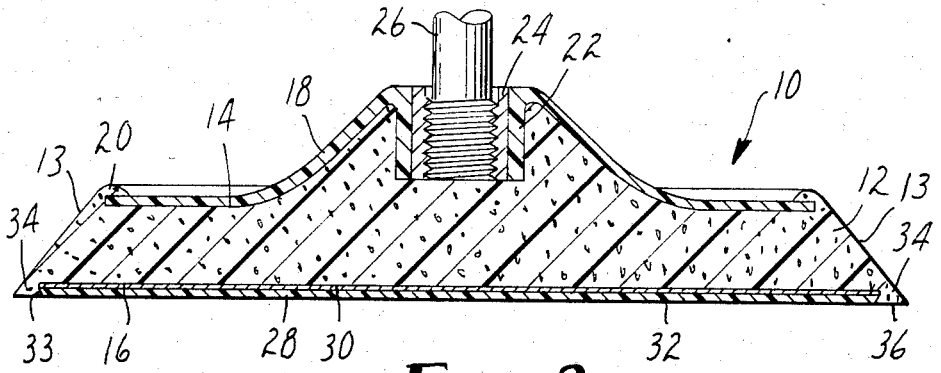
FIG. 2 is an enlarged sectional view taken generally along line 2—2 of FIG. 1.
Figure 1:
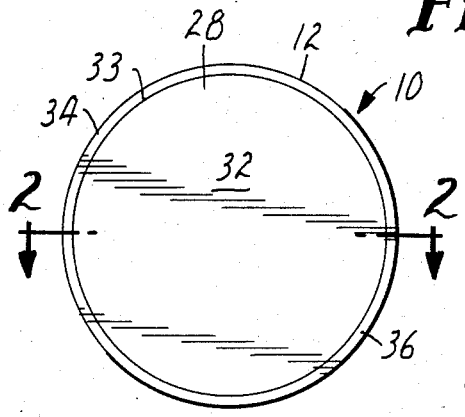
FIG. 1 is a bottom view of a first embodiment of a coated abrasive back up pad according to the present invention.

Referring now to FIGS. 1 and 2 there is shown a first embodiment of an abrasive back up pad according to the present invention, generally designated by the reference numeral 10, which back up pad 10 is adapted for use on a circular grinder.

The back up pad 10 comprises a layer 12 of tough, dense, stiff, resiliently compressible foam (e.g., closed cell polyether urethane foam) having a peripheral edge surface 13 in the shape of a conical frustum, and having first and second generally parallel spaced surfaces 14 and 16 with the surface 16 and outer portions of the surface 14 disposed generally normal to the axis of the layer of foam 12. A circular rigid polymeric (e.g. polypropylene) backing plate 18 is coaxially fixed to the first surface 14 of the layer of foam 12 with its peripheral edge protected within an annular ridge 20 formed on the foam layer 12. The rigid backing plate has a concentric frustoconical central portion projecting away from the surface 16 of the foam layer 12 and including a concentric cylindrical central collar 22 in which is fixed a knurled nut 24 (e.g. having a ⅝ 11 inner thread), which nut 24 provides means adapted for coupling the back up pad 10 to a threaded drive shaft 26 of a drive motor (not shown). The back up pad 10 also includes a flexible magnetized layer fixed to the second surface 16 of othe layer of foam 12 and comprising a layer 28 of magnetized particles within a polymeric backing, and a thin steel backing layer 30 with a neoprene coating that affords adhesion to the foam layer 12 between the layer 28 of magnetized particles and the foam layer 12 (e.g., BX 1035 "Plastiform" 0.030 inch thick including a 0.002 inch thick steel backing layer).

The magnetized layer 28 has a generally planar circular support surface 32 opposite the layer of foam 12 and a peripheral edge surface 33 adjoining the support surface 32 that is disposed generally normal to the support surface 32 even though it is beveled somewhat inwardly (e.g., about 5 to 10 degrees) toward the center of the layer of foam 12 to help hold the magnetized layer 28 in place. The foam layer 12 includes a lip 34 extending around the peripheral edge surface 33 of the magnetized layer 28, which lip 34 has a peripheral surface 36 generally coplanar with the support surface 32 on the magnetized layer 28 so that both of these surfaces 32 and 36 provide support for a sheet of abrasive material (not shown) positioned on the back up pad 10.

Preferably the back up pad 10 is formed by forming the layer of foam 12 in an appropriate mold between the magnetized layer 28 and the backing plate 18 from a mixture of 18 grams of JFC-10-86A and 72 grams of JFC-10-86B (both of which are available from Isocyanate Products, Inc., Isofoam Systems, 900 Wilmington Road, New Castle, Del.) to which has been added 1 percent water by weight to produce a softer, more conformable and lighter layer of foam 12. Preferably the support surface 32 of the pad 10 is coated with a uretuane resin to provide added abrasion resistance for the support surface 32.

Figure 3:
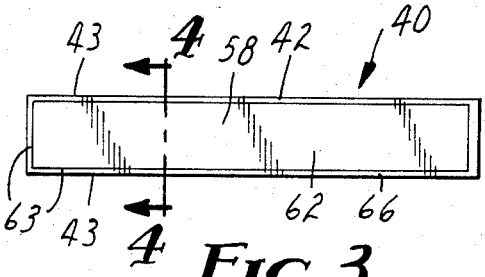
FIG. 3 is a bottom view of a second embodiment of a back up pad according to the present invention.
Figure 4:
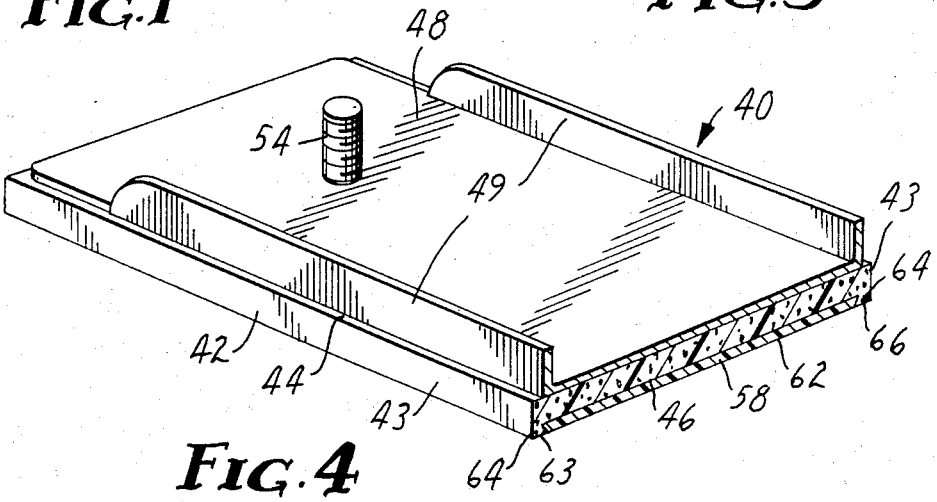
FIG. 4 is an enlarged perspective sectional view taken approximately along line 4–4 of FIG. 3.

Referring now to FIGS. 3 and 4 there is shown a second embodiment of an abrasive back up pad according to the present invention, generally designated by the reference numeral 40, which back up pad 40 is adapted for use on an air file (not shown).

The back up pad 40 comprises a layer 42 of tough, dense, stiff, resiliently compressible foam (e.g., closed cell polyether urethane foam) having a rectangular shaped peripheral edge surface 43 and having first and second generally parallel spaced surfaces 44 and 46. A generally rectangular rigid metal (e.g. aluminum) backing plate 48 with upturned longitudinal edge portions 49 for added rigidity is fixed to the first surface 44 of the layer of foam 42 and has studs 54 projecting from its surface opposite the layer of foam 42 to provide means for coupling the back up pad 40 to air drive motor (not shown). The back up pad 40 also includes a flexible magnetized layer 58 comprising magnetized particles within a polymeric backing (e.g. two 0.030 inch thick face to face layers of B-1044 "Plastiform" from 3M). The magntized layer 58 has a generally planar rectangular support surface 62 opposite the layer of foam 42 and a peripheral edge surface 63 adjoining the support surface 62 that is disposed generally normal to the support surface 32 even though it is beveled somewhat toward the center of the layer of foam 42 to help hold the magnetized layer 58 in place. The foam layer 42 includes a lip 64 extending around the peripheral surface 63 of the magnetized layer 58, which lip 64 has a peripheral surface 66 generally coplanar with the support surface 62 on the magnetized layer 58 so that both of these surfaces 62 and 64 provide support for a sheet of abrasive material (not shown) positioned on the back up pad 40. The layer of foam 42 is preferably of the same mixture described above for the layer of foam 12 in the pad 10, and the support surface 62 is also preferably coated with the same resin for abrasion resistance.

It has been found that in back up pads like either the back up pad 10 or the back up pad 40 a lip in the range of about 174 to 1 centimeter thick in a direction generally normal to the edge surface 33 or 63 provides good protection for the edge surface 33 or 63 of the magnetized layer 28 or 58 and adheres well to its edge surface 33 or 63 to preclude separation therebetween.

It will be appreciated that modifications can be made to the back up pads 10 and 40 described above and that back up pads of other shapes can be made without departing from the spirit of the present invention. For example the present invention is useful for making hand sanding back up pads, where the layer of foam is preferably polyester urethane foam. Thus the scope of the present invention as defined by the dependent claims should not be limited to the structures of the back up pads illustrated, but should include all structures described by the language of the claims and their equivalents.

I claim:

1. In a coated abrasive back up pad comprising a layer of resiliently compressible foam having first and second spaced surfaces a generally rigid backing plate fixed to said first surface of said backing plate, means attached to said backing plate adapted for coupling said back up pad to a drive motor, and a flexible magnetized layer comprising magnetized particles within a polymeric matrix fixed to the second surface of said layer of foam, having a generally planar support surface opposite said layer of foam and having an edge surface adjoining and disposed generally normal to the support surface, the improvement wherein:

said foam layer includes a lip extending around the edge surface of said magnetized layer, said lip having a peripheral surface generally coplanar with said support surface;

both said support surface and said peripheral surface are adapted to provide support for a sheet of abrasive material positioned on the back up pad; and said edge surface of said magnetized layer is beveled inwardly from the second surface of the layer of foam toward said support surface to help hold the magnetized layer in the layer of foam.

2. A back up pad according to claim 1 wherein said lip is in the range of about ¼ to 1 centimeter thick in a direction generally normal to said edge surface.

3. A back up pad according to claim 1 wherein the periphery of said layer of foam is rectangular.

4. A back up pad according to claim 1 wherein the periphery of said layer of foam is in the shape of a conical frustum.

5. A back up pad according to claim 1 wherein said layer of foam is of polyether urethane.

6. In a coated abrasive back up pad comprising a layer of resiliently compressible foam having first and second spaced surfaces, and a flexible magnetized layer comprising magnetized particles within a polymeric matrix fixed to the second surface of said layer of foam, having a generally planar support surface opposite said layer of foam and having an edge surface adjoining and disposed generally normal to the support surface, the improvement wherein:

said foam layer includes a lip extending around the edge surface of said magnetized layer, said lip having a peripheral surface generally coplanar with said support surface;

both said support surface and said peripheral surface are adapted to provide support for a sheet of abrasive material positioned on the back up pad; and said edge surface of said magnetized layer is beveled inwardly from the second surface of the layer of foam toward said support surface to help hold the magnetized layer in the layer of foam.

7. A back up pad according to claim 6 wherein said lip is in the range of about ¼ to 1 centimeter thick in a direction generally normal to said edge surface.

8. A back up pad according to claim 6 wherein the periphery of said layer of foam is rectangular.

9. A back up pad according to claim 6 wherein the periphery of said layer of foam is in the shape of a conical frustum.

10. A back up pad according to claim 6 wherein said layer of foam is of polyester urethane.

* * * * *